US007466270B2

(12) United States Patent
Utagawa et al.

(10) Patent No.: US 7,466,270 B2
(45) Date of Patent: Dec. 16, 2008

(54) PLANAR ANTENNA

(75) Inventors: Naoaki Utagawa, Gunma (JP); Takashi Nozaki, Gunma (JP); Ichiro Tsuzuku, Gunma (JP); Naoki Sotoma, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/812,093

(22) Filed: Jun. 14, 2007

(65) Prior Publication Data

US 2007/0290931 A1 Dec. 20, 2007

(30) Foreign Application Priority Data

Jun. 15, 2006 (JP) ..... 2006-166423

(51) Int. Cl.
*H01Q 1/38* (2006.01)

(52) U.S. Cl. ..... 343/700 MS; 343/846

(58) Field of Classification Search ..... 343/700 MS, 343/846, 829, 830

See application file for complete search history.

(56) References Cited

U.S. PATENT DOCUMENTS

| | | | | |
|---|---|---|---|---|
| 4,069,483 | A * | 1/1978 | Kaloi | 343/700 MS |
| 4,386,357 | A * | 5/1983 | Patton | 343/700 MS |
| 4,827,271 | A * | 5/1989 | Berneking et al. | 343/700 MS |
| 6,806,831 | B2 * | 10/2004 | Johansson et al. | 343/700 MS |
| 2007/0171132 | A1 | 7/2007 | Utagawa et al. | 343/700 |

FOREIGN PATENT DOCUMENTS

| | | |
|---|---|---|
| EP | 1 246 299 A2 | 10/2002 |
| EP | 1 814 193 A1 | 8/2007 |
| JP | 5-136625 | 6/1993 |
| JP | 2002-359515 | 12/2002 |
| WO | WO 01/18910 A1 | 3/2001 |

* cited by examiner

*Primary Examiner*—Tho G Phan
(74) *Attorney, Agent, or Firm*—Morgan, Lewis & Bockius LLP

(57) ABSTRACT

A plate member is adapted to be electrically grounded. A first radiating electrode opposes the plate member with a gap and extending parallel to the plate member. A second radiating electrode opposes the plate member with a gap and extending parallel to the plate member. A feeding pin is connected to a center part of the first radiating electrode and a center part of the second radiating electrode. The feeding pin is adapted to feed power to the first radiating electrode and the second radiating electrode. A pair of first short-circuiting pins are electrically connecting the plate member and an outer edge of the first radiating electrode at symmetrical positions relative to the feeding pin. A pair of second short-circuiting pins are electrically connecting the plate member and both ends of the second radiating electrode. The first radiating electrode is formed with blank portions which are located at such positions that are on hypothetical straight lines connecting the feeding pin and the short pins. The first radiating electrode and the second radiating electrode are flush with each other.

6 Claims, 7 Drawing Sheets

PLANAR ANTENNA

BACKGROUND

The present invention relates to a planar antenna that is small in size and low profile, and is adapted to operate in a plurality of frequency bands.

As a conventional planar antenna having a small size and low profile, an M-type antenna having a flat radiating electrode is disclosed in Japanese Patent Publication No. 5-136625A, which will be described with reference to FIGS. 10 and 11.

In the conventional M-type antenna as shown in FIG. 10, a radiating electrode 12, which is formed of a flat conductive plate and whose planar outer shape is square, is disposed to be spaced apart from a grounding plate 10 and parallel to the grounding plate 10. A feeding pin 14 is erected from the side of the grounding plate 10 and is electrically connected to an approximate center portion of the radiating electrode 12. In addition, at approximately symmetrical locations relative to the location where the feeding pin 14 is disposed, a pair of short-circuiting pins 16 are provided such that center locations of outer edge portions of two opposing sides of the radiating electrode 12 are electrically connected to the grounding plate 10. The feeding pin 14 is electrically isolated from the grounding plate 10.

The VSWR characteristics of the M-type antenna having such a structure is illustrated in FIG. 11. As an example, it is adapted to operate in a single frequency band around 900 MHz.

Further, as an antenna adapted to operate in two frequency bands, the technology combining two M-type antennas each formed of a conductive wire is disclosed in Japanese Patent Publication No. 2002-359515A.

Referring to FIGS. 12 to 14, a brief explanation will be given of the M-type antenna disclosed in this publication. In the structure shown in FIG. 12, a first radiating electrode 18 formed of a conductive wire is arranged away from and in parallel to a grounding plate 10, and at a nearly central position thereof, a feeding pin 14 is caused to be erected from the side of the grounding plate 10 and electrically connected to the first radiating electrode 18. A pair of short-circuiting pins 20 are provided so as to electrically connect both ends of the first radiating electrode 18 to the grounding plate 10. At the intermediate position of the feeding pin 14, a second radiating electrode 22 formed of a conductive wire is arranged in parallel to the grounding plate 10 and the first radiating electrode 18. The feeding pin 14 is connected to the nearly central position of the second radiating electrode 22. A pair of short-circuiting pins 24 are provided so as to electrically connect both ends of the second radiating electrode 22 to the grounding plate 10. The horizontal directivity characteristics of the M-type antenna having such a structure is illustrated in FIGS. 13 and 14. As seen, it is not considered that both first and second radiating electrodes 18, 22 has omni-directivity on the horizontal plane.

Meanwhile, recent electronic devices having functions to support various media and services require an antenna capable of operating in a plurality of frequency bands. In addition, generally, the installing space for the antenna is limited. The M-type antenna disclosed in Japanese Patent Publication No. 5-136625A can operate only in a single frequency band. So, in order to communicate a plurality of frequency bands, another antenna must be additionally mounted. In this case, such another to be added is obliged to be aside or above the radiating electrode 12. This correspondingly requires a wide or tall installing space.

The recent electronic devices having functions to support various media and services are mostly mounted on a vehicle and are required to have omni-directivity on the horizontal plane of the antenna. The M-type antenna disclosed in Japanese Patent Publication No. 2002-359515A can operate in two frequency bands while making the installing space smaller, However, there is a drawback in that its horizontal directivity is not omni-directive.

SUMMARY

It is therefore one advantageous aspect of the invention to provide a planar antenna using an M-type antenna as a basic structure, that is capable of maintaining omni-directivity on the horizontal plane without increasing a height by which a radiating electrode is spaced apart from a grounding plate and without expanding a shape of the radiating electrode.

It is also one advantageous aspect of the invention to provide a planar antenna that is capable of disposing an additional antenna without increasing an arrangement space.

It is also one advantageous aspect of the invention to provide a planar antenna capable of arbitrarily setting operable frequency bands.

According to one aspect of the invention, there is provided a planar antenna, comprising:

a plate member, adapted to be electrically grounded;

a first radiating electrode, opposing the plate member with a gap and extending parallel to the plate member;

a second radiating electrode, opposing the plate member with a gap and extending parallel to the plate member;

a feeding pin, connected to a center part of the first radiating electrode and a center part of the second radiating electrode, the feeding pin being adapted to feed power to the first radiating electrode and the second radiating electrode;

a pair of first short-circuiting pins, electrically connecting the plate member and an outer edge of the first radiating electrode at symmetrical positions relative to the feeding pin; and a pair of second short-circuiting pins, electrically connecting the plate member and both ends of the second radiating electrode;

wherein the first radiating electrode is formed with blank portions which are located at such positions that are on hypothetical straight lines connecting the feeding pin and the short pins; and wherein the first radiating electrode and the second radiating electrode are flush with each other.

The first radiating electrode and the second radiating electrode may be formed from conductive wires.

The first radiating electrode and the second radiating electrode may be formed from conductive strips.

With the above configuration, since the blank portions are formed without providing the conductive members linearly connecting the position where the feeding pin is arranged and the position where the short-circuiting pins are arranged, the current path between the feeding pin and the short-circuiting pins is longer than the distance of linearly connecting them. Thus, without increasing the height of separating the first radiating electrode from the grounding plate and without upsizing the shape of the first radiating electrode, the resonance frequency can be lowered. Further, since the second radiating electrode is provided in the blank portions where the conductive members are not provided, there is provided an antenna capable of operating in two frequency bands without changing the outer size, in such a manner that the first and second radiating electrodes communicate frequency bands different from each other.

The first radiating electrode may be shaped into a square formed with four triangular blank portions. One of vertexes of each of the triangular blank portions may oppose the feeding pin and the other vertexes thereof may oppose corners of the square conductive plate. The first short-circuiting pins may be disposed on intermediate portions of two opposing sides of the square conductive plate. The both ends of the second radiating electrode may be disposed in two of the blank portions not opposing the first short-circuiting pins.

The first radiating electrode may be a circular conductive plate formed with four fan-shaped blank portions. A vertex of each of the fan-shaped blank portions may oppose the feeding pin and an arcuate portion thereof may oppose an outer periphery of the circular conductive plate. The first short-circuiting pins may be disposed on positions opposing arcuate portions of opposing two of the blank portions. The both ends of the second radiating electrode may be disposed in two of the blank portions not opposing the first short-circuiting pins.

With any one of the above configurations, the blank portions provided in the first radiating electrode are nearly point-symmetrical with respect to center where the feeding pin is arranged. For this reason, omni-directivity in the horizontal plane can be obtained. In addition, in the blank portions of the sides where the first short-circuiting pins of the first radiating electrode are not provided, the second radiating electrode is provided. So, there is less influence of the second radiating electrode on the current/voltage distribution generated in the first radiating electrode.

The planar antenna may further comprise an additional antenna disposed on the plate member so as to oppose one of the blank portions.

With this configuration, the additional antenna is arranged in the blank portion of the first radiating electrode, the space can be effectively employed. Thus, even where the additional antenna is built in the blank portion, the installing space will not be increased and also the height will not increase.

DETAILED DESCRIPTION OF EXEMPLARY EMBODIMENTS

Figure 10:
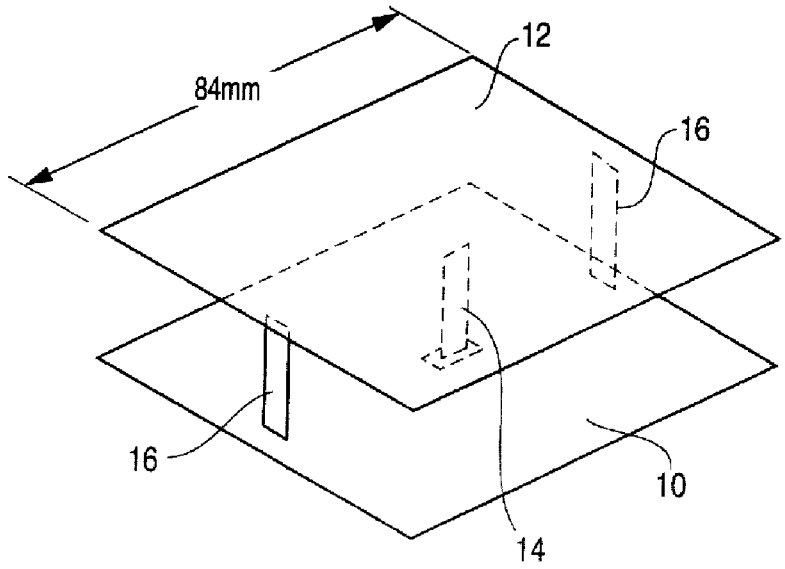
FIG. 10 PRIOR ART
FIG. 10 is a perspective view of a first conventional planar antenna.
Figure 11:
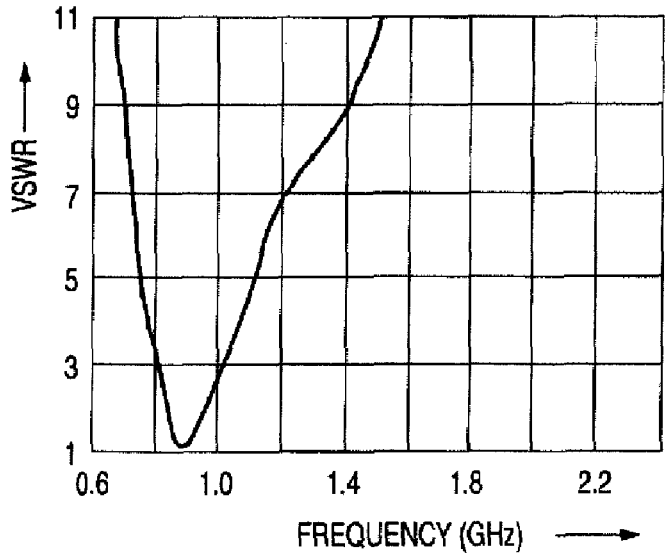
FIG. 11 PRIOR ART
FIG. 11 is a VSWR characteristic graph of the first conventional planar antenna.
Figure 12:
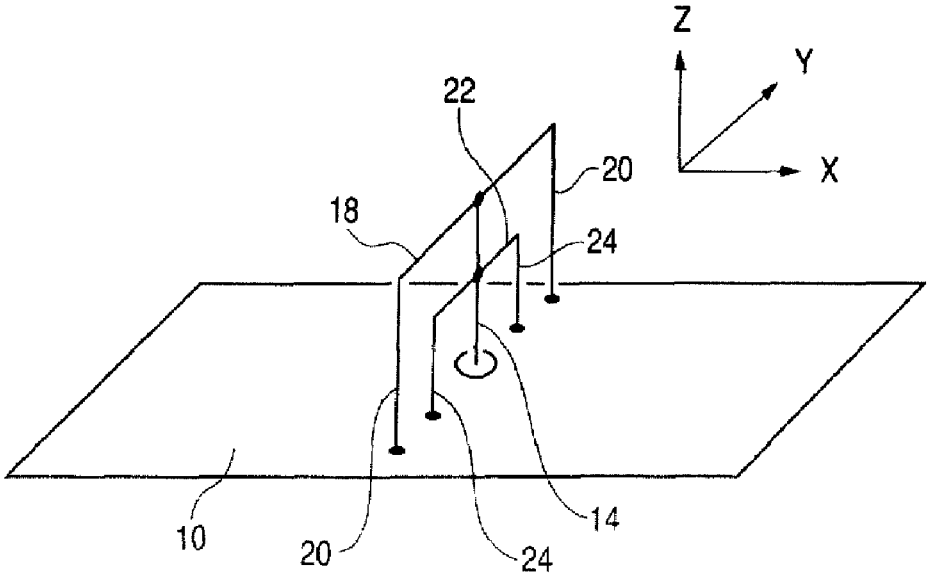
FIG. 12 PRIOR ART
FIG. 12 is a perspective view of a second conventional planar antenna.
Figure 13:
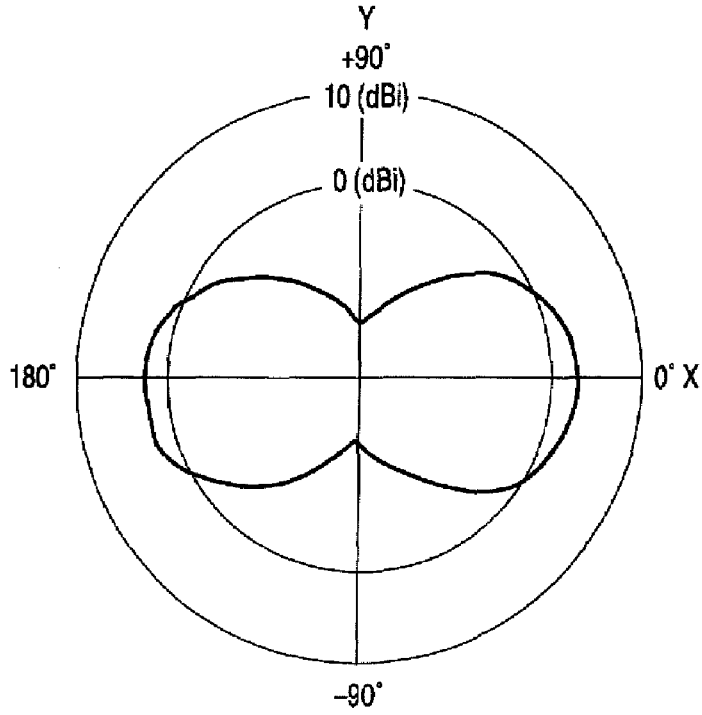
FIG. 13 PRIOR ART
FIG. 13 is a horizontal directivity graph of a first radiating electrode in the second conventional planar antenna.
Figure 14:
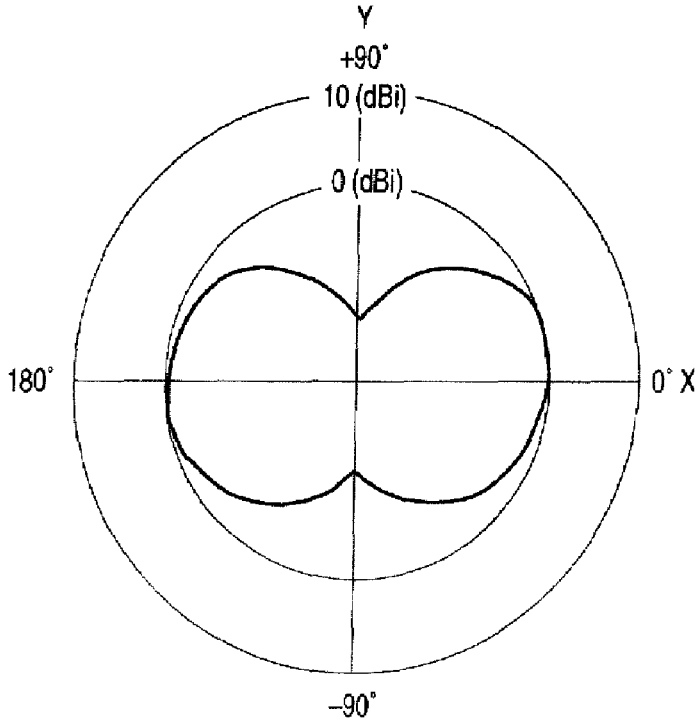
FIG. 14 PRIOR ART
FIG. 14 is a horizontal directivity graph of a second radiating electrode in the second conventional planar antenna.

Exemplary embodiments of the invention will be described below in detail with reference to the accompanying drawings. Components similar to those in the conventional antennas shown in FIGS. 10 and 12 will be designated by the same reference numerals.

Figure 1:
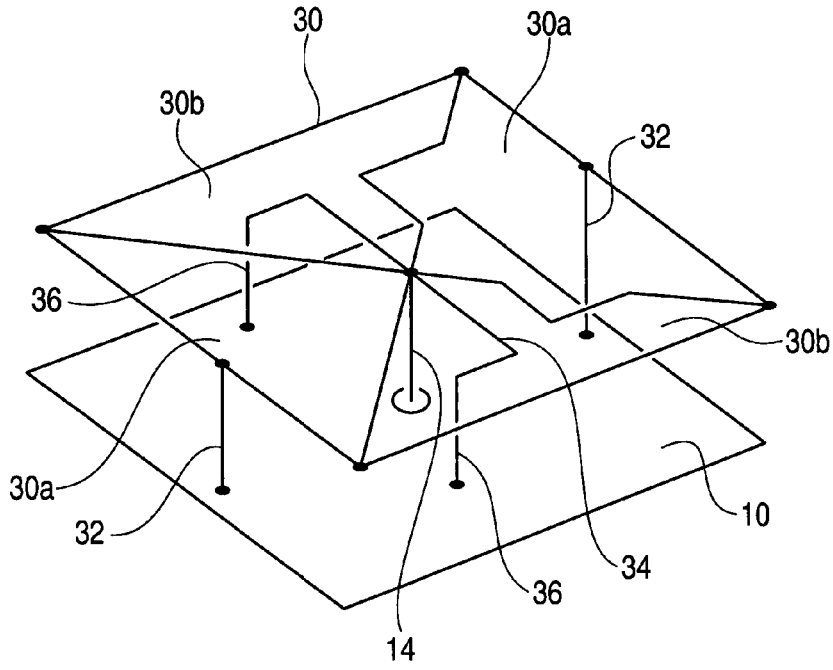
FIG. 1 is a perspective view of a planar antenna according to a first embodiment of the invention.

As shown in FIG. 1, in a planar antenna according to a first embodiment, a first radiating electrode 30 is arranged away from and within a plane in parallel to a grounding plate 10. The first radiating electrode 30 has a frame portion formed by conductive wires. Diagonal corners of the frame portion are connected by arms formed of conductive wires which crosses at a central portion, at which a feeding pin 14 is caused to be erected from the side of the grounding plate 10. It is needless to say that the feeding pin 14 is not electrically connected to the grounding plate 10.

At symmetrical positions with respect to the feeding pin 14, a pair of the first short-circuiting pins 32 are provided at the nearly central positions of two sides of the square frame so as to electrically short-circuit the frame portion of the first radiating electrode 30 to the grounding plate 10. In the first radiating electrode 30, there are no conductive wires which linearly connect the feeding pin 14 and the first short-circuiting pins 32, but triangular blank areas 30*a* are formed. Further, there are no conductive wires which linearly connect the feeding pin 14 and the sides of the frame portion in which the first short-circuiting pins 32 are not provided, but triangular blank areas 30*b* are likewise formed.

Furthermore, a second radiating electrode 34 is provided in the triangular blank areas 30*b*. The second radiating electrode 34 is formed by a conductive wire so as to have a square bracket shape and made flush with the first radiating electrode 30 is arranged. Moreover, there are provided second short-circuiting pins 36 which electrically short-circuit both ends of the second radiating electrode 34 to the grounding plate 10. The feeding pin 14 is electrically connected to the central position of the second radiating electrode 34.

Figure 2:
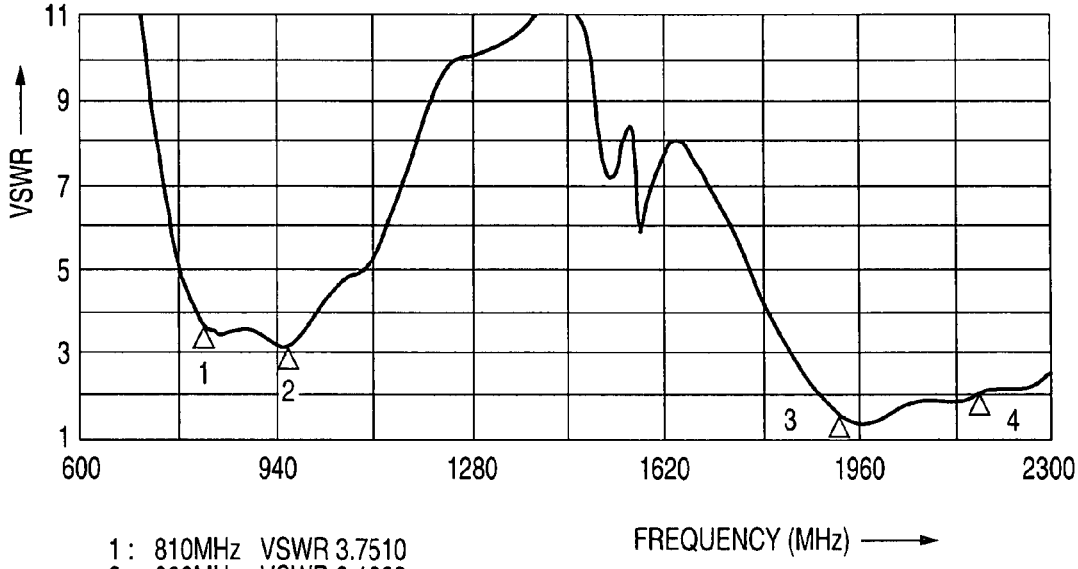
FIG. 2 is a VSWR characteristic graph of the planar antenna of FIG. 1.

In the planar antenna according to this embodiment, the length of one side of the square frame portion of the first radiating electrode 30 is 84 mm, its height separated from the grounding plate 10 is 16.5 mm, and the shape (including length) of the second radiating electrode 34 is appropriately adjusted. This planar antenna, as seen from FIG. 2, is operable in two frequency bands. The first radiating electrode 30 is set at a 800 MHz band for PDC 800 (for cellular phones) as a first frequency band. The second radiating electrode 34 is set at a 2 GHz band for IMT-2000 as a second frequency band. Now, the length of the second radiating electrode 34 may be set so that the sum of the length of the wire connecting the feeding pin 14 and second short-circuiting pin 36 and the respective lengths of the feeding pin 14 and second short-circuiting pin 36 is a ½ wavelength at the central frequency of the second frequency band.

Figure 3:
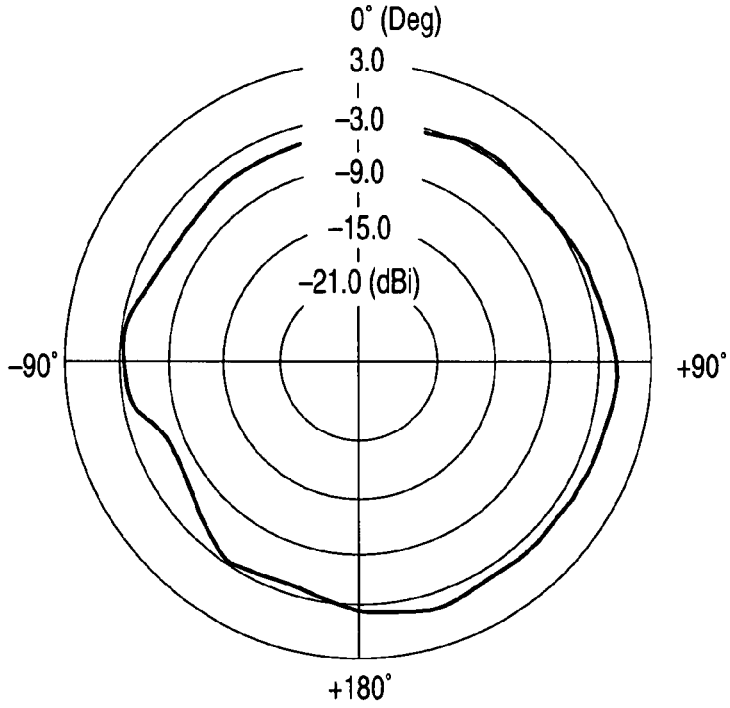
FIG. 3 is a horizontal directivity graph of the planar antenna of FIG. 1 at 810 MHz.
Figure 4:
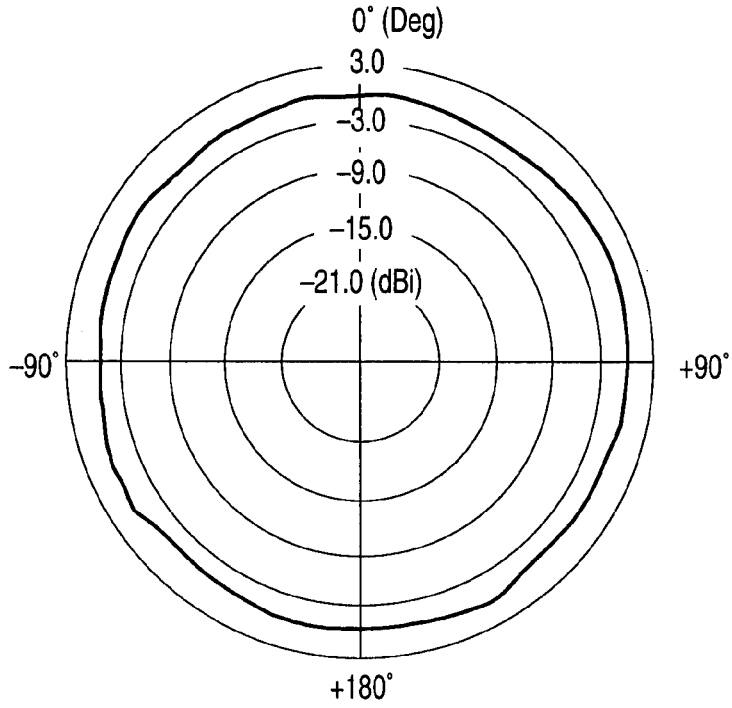
FIG. 4 is a horizontal directivity graph of the planar antenna of FIG. 1 at 960 MHz.
Figure 5:
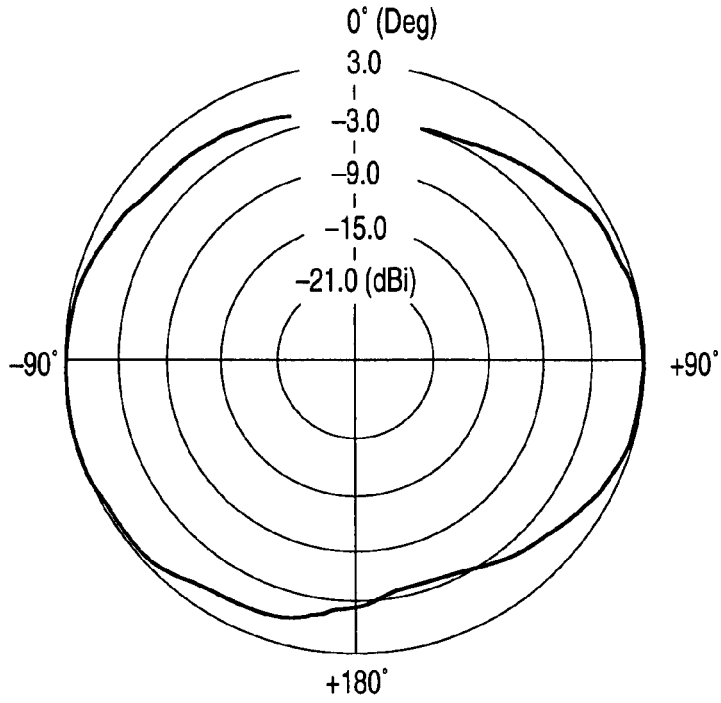
FIG. 5 is a horizontal directivity graph of the planar antenna of FIG. 1 at 1920 MHz.
Figure 6:
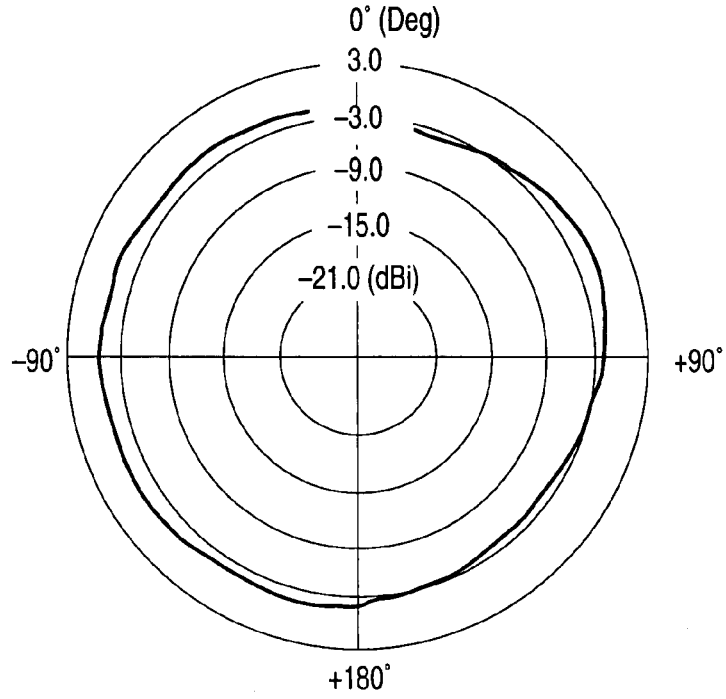
FIG. 6 is a horizontal directivity graph of the planar antenna of FIG. 1 at 2170 MHz.

In the VSWR characteristic illustrated in FIG. 2, at 810 MHz of PDC 800 as the first frequency band, VSWR is 3.75 and the gain at the elevation angle $\theta=0°$ is −2.85 dBi; at 960 MHz thereof, VSWR is 3.16 and the gain is 0.01 dBi; at 1920 MHz of IMT-2000 as the second frequency band, VSWR is 1.40 and the gain is 0.52 dBi, and at 2170 MHz thereof, VSWR is 2.06 and the gain is −1.96 dBi. In addition, as seen from FIGS. 3 and 4, at both 810 MHz and 960 MHz, PDC 800 gives nearly omni-directivity on the horizontal plane. Further, as seen from FIGS. 5 and 6, at both 1920 MHz and 2170 MHz, IMT-2000 gives nearly omni-directivity on the horizontal plane.

Further, in the blank areas 30*b* with no first short-circuiting pins 32, the second radiating electrode 34 is provided. For this reason, there is no possibility of electro-magnetic coupling or capacitive coupling between the feeding pin 14 connected to the first radiating electrode 30 and the first short-circuiting pins 32 through the second radiating electrode 34. The provision of the second radiating electrode 34 gives less influence on the current/voltage distribution of the first radiating electrode 30 and therefore no influence on the antenna characteristics.

Next, a second embodiment of the invention will be described with reference to FIG. 7. Components similar to those in the first embodiment will be designated by the reference numerals and repetitive explanations for those will be omitted.

The second embodiment is different from the first embodiment in that the first and second radiating electrodes 30, 34, pairs of the first and second short-circuiting pins 32, 36 and the feeding pin 14 are formed in a conductive strips in place of the conductive wires. In this embodiment, a flat conductive plate is appropriately processed and bent so that the shapes of the respective members are substantially the same as those in the first embodiment. As in the first embodiment, the first and second radiating electrodes 30, 34 are arranged away from and in parallel to the grounding plate 10. Also in the planar antenna according to the second embodiment having such a structure, the same antenna characteristics as the planar antenna according to the first embodiment can be obtained. In addition, since the width of the strip-shaped first and second radiating electrodes 30, 34 is greater than that of the conductive wires in the first embodiment, the operable band width is increased.

Additionally, in the second embodiment, the first and second radiating electrodes 30, 34 are formed of the conductive plate. However, the following configuration may be adopted. Namely, for example, a synthetic resin plate is provided at the height where the first and second radiating electrodes 30, 34 are to be provided. On the surface of the plate, the first and second radiating electrodes 30, 34 of a conductive thin film are formed. To the first and second radiating electrodes 30, 34 of the conductive thin film, the first and second short-circuiting pins 32, 36 and the feeding pin 14 are electrically connected.

Next, a third embodiment of the invention will be described with reference to FIG. 8. Components similar to those in the above embodiments will be designated by the reference numerals and repetitive explanations for those will be omitted.

The third embodiment is different from the first embodiment in that the shape of a first radiating electrode 40 made of the conductive wire is circular, and a second radiating electrode 44 is formed in a linear shape. Also in the planar antenna according to the third embodiment having such a structure, the same antenna characteristics as the planar antenna according to the first embodiment can be obtained.

Next, a fourth embodiment of the invention will be described with reference to FIG. 9. Components similar to those in the above embodiments will be designated by the reference numerals and repetitive explanations for those will be omitted.

In the fourth embodiment, in the blank areas 30*a* with no second radiating electrode 34, an additional antenna 50 for GPS reception and an additional antenna 52 for reception of satellite digital radio broadcasting are arranged. In such a structure, the space can be effectively used, so that, although the additional antennas 50, 52 are arranged, the installing space will not be increased. It is needless to say that as these additional antennas 50, 52, the antennas for DSRC or wireless LAN inclusive of ETC, Bluetooth, etc. can be adopted.

It should be noted that the shape of the first radiating electrodes 30, 40 should not be limited to the shape proposed in the embodiments described above, Examples will be described as follows.

The length of the first radiating electrode may be increased by bending each of the arms forming the cross-shaped portion shown in FIG. 1. Alternatively, some of the arms forming the cross-shaped portion may be bent and the others may not be bent.

The center part of the first radiating electrode may be formed by a single linear portion and both ends of the linear portion may be branched and coupled to the respective corners of the square frame portion.

The center part of the first radiating electrode may be formed by a single linear portion and both ends of the linear portion may be branched and coupled to two sides of the square frame portions, thereby forming an H-shaped portion.

Each of the arms forming the cross-shaped portion shown in FIG. 1 may be bent in a meandering manner, so that its length is increased, The cross-shaped portion of the first radiating electrode may be formed by such a manner that the arms are coupled to the intermediate portions of the respective sides of the square frame portion, and the short-circuiting pins may be disposed at two diagonal corners of the square frame portion.

Figure 7:
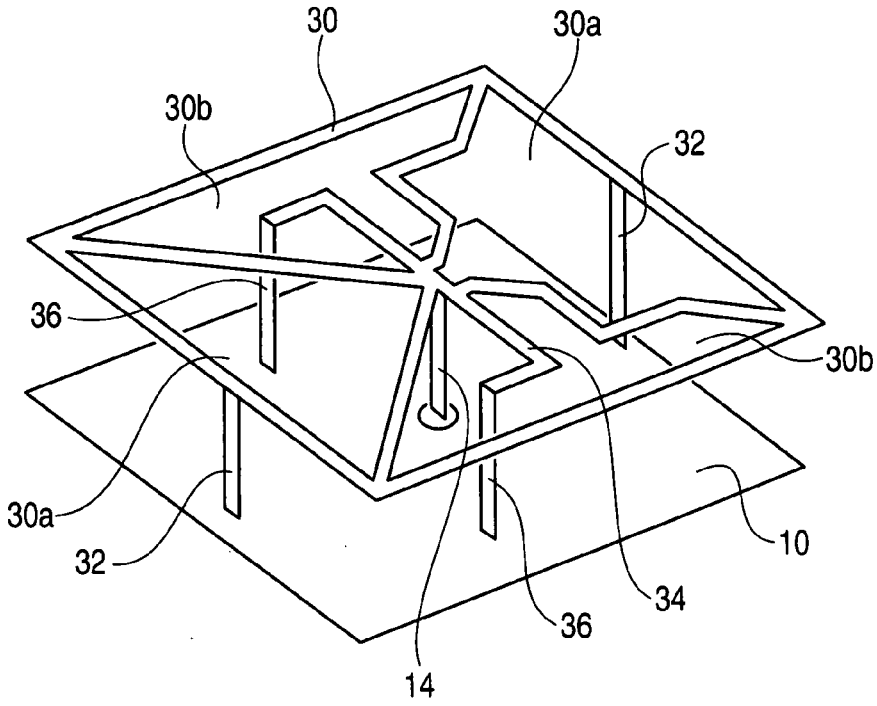
FIG. 7 is a perspective view of a planar antenna according to a second embodiment of the invention.
Figure 9:
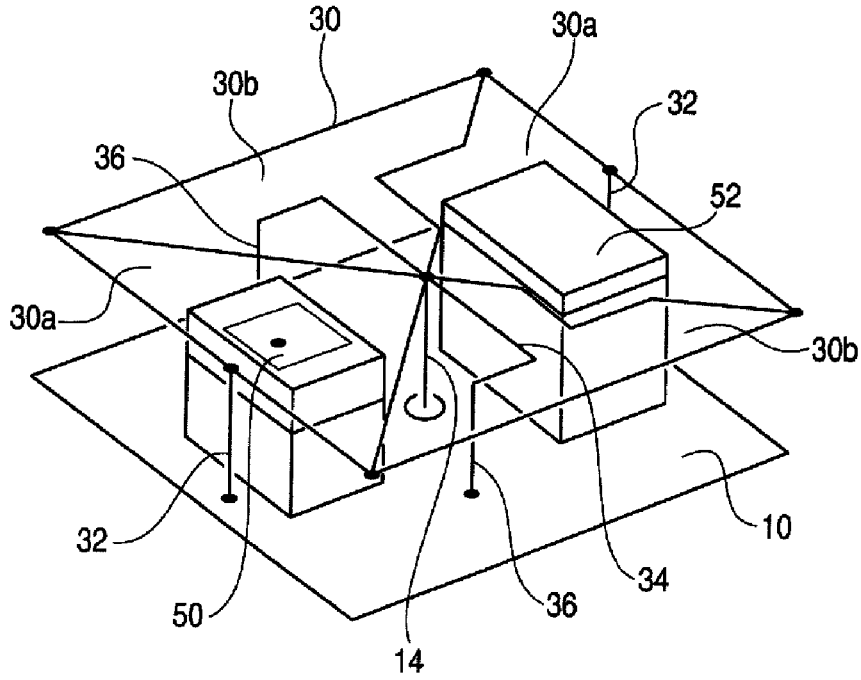
FIG. 9 is a perspective view of a planar antenna according to a fourth embodiment of the invention.

The edge portions of the square frame portion of the first radiating electrode shown in FIGS. 1, 7 and 9 where the short-circuit pins 16 are not disposed may be removed.

Figure 8:
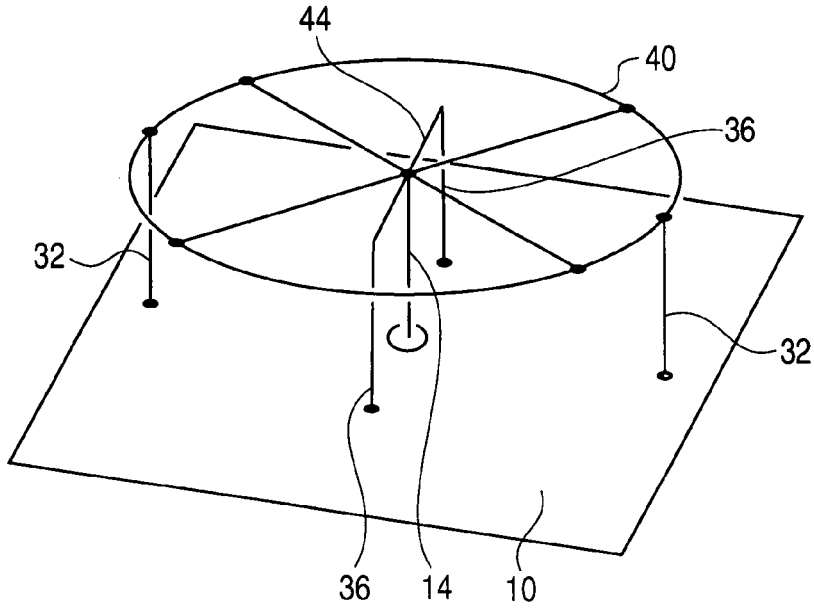
FIG. 8 is a perspective view of a planar antenna according to a third embodiment of the invention.

The edge portions of the circular frame portion of the first radiating electrode shown in FIG. 8 where the short-circuiting pins 16 are not disposed may be removed.

The first radiating electrode may have a shape in which two rings having the same shape are disposed such that portions of the rings come into contact with each other or overlap each other. The feeding pin 14 may be disposed at a portion where two rings come into contact with each other, and the short-circuiting pins 16 may be respectively disposed at the other locations of the rings on a line passing through the arrangement location of the feeding pin 14.

The first radiating electrode may have a shape in which two rectangular frames having the same shape are disposed such that portions of the rectangular frames come into contact with each other or overlap each other. The feeding pin 14 may be disposed at a portion where two rectangular frames come into contact with each other, and the short-circuiting pins 16 may be respectively disposed at the other locations of the rectangular frames on a line passing through the arrangement location of the feeding pin 14.

Further, the shape of the second radiating electrodes should not be limited to the above-described shapes but may be changed in accordance with the prescribed antenna requirements.

In the above embodiments, the second radiating electrode is provided in the blank areas 30*b* where the first short-circuiting pins 32 are not provided. However, the second radiating electrode may be provided in the blank areas 30*a* where the first short-circuiting pins 32 are provided. Nevertheless, as compared with the case where the second radiating electrode is arranged in the blank areas 30*b* where the first short-circuiting pins 32 are not provided, in the case where the second radiating electrode is arranged in the blank areas 30*a* where the first short-circuiting pins 32 are provided, since the first short-circuiting pins 32 and the second short-circuiting pins 36 are arranged adjacently to each other, the electromagnetic coupling is likely to occur so that there is a slight tendency to deteriorate the directivity of the horizontal plane.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2006-166423 filed Jun. 15, 2006 including specification, drawings and claims are incorporated herein by reference in their entirety.

What is claimed is:

1. A planar antenna, comprising:

a plate member, adapted to be electrically grounded;

a first radiating electrode, opposing the plate member with a gap and extending parallel to the plate member;

a second radiating electrode, opposing the plate member with a gap and extending parallel to the plate member;

a feeding pin, connected to a center part of the first radiating electrode and a center part of the second radiating electrode, the feeding pin being adapted to feed power to the first radiating electrode and the second radiating electrode;

a pair of first short-circuiting pins, electrically connecting the plate member and an outer edge of the first radiating electrode at symmetrical positions relative to the feeding pin; and a pair of second short-circuiting pins, electrically connecting the plate member and both ends of the second radiating electrode;

wherein the first radiating electrode is formed with blank portions which are located at such positions that are on hypothetical straight lines connecting the feeding pin and the short pins; and wherein the first radiating electrode and the second radiating electrode are flush with each other.

2. The planar antenna as set forth in claim 1, wherein:

the first radiating electrode and the second radiating electrode are formed from conductive wires.

3. The planar antenna as set forth in claim 1, wherein:

the first radiating electrode and the second radiating electrode are formed from conductive strips.

4. The planar antenna as set forth in claim 1, wherein:

the first radiating electrode is shaped into a square formed with four triangular blank portions;

one of vertexes of each of the triangular blank portions opposes the feeding pin and the other vertexes thereof oppose corners of the square conductive plate;

the first short-circuiting pins are disposed on intermediate portions of two opposing sides of the square conductive plate; and the both ends of the second radiating electrode are disposed in two of the blank portions not opposing the first short-circuiting pins.

5. The planar antenna as set forth in claim 1, wherein:

the first radiating electrode is a circular conductive plate formed with four fan-shaped blank portions;

a vertex of each of the fan-shaped blank portions opposes the feeding pin and an arcuate portion thereof opposes an outer periphery of the circular conductive plate;

the first short-circuiting pins are disposed on positions opposing arcuate portions of opposing two of the blank portions; and the both ends of the second radiating electrode are disposed in two of the blank portions not opposing the first short-circuiting pins.

6. The planar antenna as set forth in claim 5, further comprising:

an additional antenna disposed on the plate member so as to oppose one of the blank portions.

* * * * *